US010967531B2

(12) United States Patent
Griffin et al.

(10) Patent No.: US 10,967,531 B2
(45) Date of Patent: Apr. 6, 2021

(54) RAZOR CARTRIDGE GUARDS

(71) Applicant: SHAVELOGIC, INC., Plano, TX (US)

(72) Inventors: John W. Griffin, Moultonborough, NH (US); Craig A. Provost, Boston, MA (US); William E. Tucker, Attleboro, MA (US); Douglas R. Kohring, Arrowsic, ME (US)

(73) Assignee: SHAVELOGIC, INC., Dallas, TX (US)

( * ) Notice: Subject to any disclaimer, the term of this patent is extended or adjusted under 35 U.S.C. 154(b) by 0 days.

(21) Appl. No.: 15/331,058

(22) Filed: Oct. 21, 2016

(65) Prior Publication Data

US 2017/0043491 A1 Feb. 16, 2017

Related U.S. Application Data

(63) Continuation of application No. PCT/US2015/027103, filed on Apr. 22, 2015.

(60) Provisional application No. 61/983,790, filed on Apr. 24, 2014.

(51) Int. Cl.
*B26B 21/40* (2006.01)

(52) U.S. Cl.
CPC ..... *B26B 21/4018* (2013.01); *B26B 21/4012* (2013.01)

(58) Field of Classification Search
CPC ..... B26B 21/4018; B26B 21/4012
USPC ..... 30/34.2, 77, 81, 82; D8/45–48, 92; D28/47
See application file for complete search history.

(56) References Cited

U.S. PATENT DOCUMENTS 2,064,884 A * 12/1936 Carlson ..... B26B 21/32 30/60
2,200,185 A * 5/1940 Muros ..... B26B 19/06 30/34.2
5,191,712 A * 3/1993 Crook ..... B26B 21/4018 30/34.05
5,794,343 A * 8/1998 Lee ..... B26B 21/4012 30/50
6,298,557 B1 * 10/2001 Gilder ..... B26B 21/4018 30/34.2
6,601,303 B2 * 8/2003 Gilder ..... B26B 21/4018 30/50
6,651,342 B1 * 11/2003 Walker, Jr. ..... B26B 21/4018 30/34.2
6,675,479 B1 * 1/2004 Walker, Jr. ..... B26B 21/4018 30/34.2
8,186,062 B2 * 5/2012 Fischer ..... B26B 21/4018 30/34.2
8,225,510 B2 * 7/2012 Peterson ..... B26B 21/4012 30/346.61

(Continued)

FOREIGN PATENT DOCUMENTS

WO 2010068075 A2 6/2010
WO 2012158141 11/2012

OTHER PUBLICATIONS

KR20100067372; english translation; Jun. 2010; Jung Hyo Kuin; B26B21/00.*

(Continued)

*Primary Examiner* — Laura M Lee
(74) *Attorney, Agent, or Firm* — Leber IP Law; Celia H. Leber

(57) ABSTRACT

Razor cartridges are disclosed that include an elastomeric guard having a plurality of curved fins.

14 Claims, 3 Drawing Sheets

(56) References Cited

U.S. PATENT DOCUMENTS

| | | | | |
|---|---|---|---|---|
| 2004/0134072 | A1 | 7/2004 | Walker, Jr. et al. | |
| 2005/0188539 | A1* | 9/2005 | Prudden, Jr. | B26B 21/4012 30/41 |
| 2006/0070240 | A1* | 4/2006 | Fischer | B26B 21/4018 30/50 |
| 2008/0034590 | A1 | 2/2008 | Prudden, Jr. et al. | |
| 2009/0193659 | A1* | 8/2009 | Park | B26B 21/225 30/50 |
| 2012/0151772 | A1* | 6/2012 | Moon | B26B 21/225 30/41 |
| 2013/0097872 | A1* | 4/2013 | Blatter | B26B 21/4018 30/50 |
| 2016/0167242 | A1* | 6/2016 | Noh | B26B 21/222 30/50 |
| 2017/0136639 | A1* | 5/2017 | Park | B26B 21/14 |

OTHER PUBLICATIONS

Search report and Written Opinion—Corresponding PCT Application No. PCT/US2015/027103, dated Jul. 16, 2015, 12 pages.
European Patent Application No. 15783488.8, Extended European Search Report dated Dec. 6, 2017.

* cited by examiner

RAZOR CARTRIDGE GUARDS

RELATED APPLICATIONS

This application is a continuation application of PCT Application Ser. No. PCT/U52015/27103, filed Apr. 22, 2015, which claims priority to U.S. Provisional Patent Application No. 61/983,790, filed Apr. 24, 2014. The complete disclosure of each of these applications is hereby incorporated by reference herein.

BACKGROUND

Razor cartridges customarily have elastomeric guards that are positioned to stretch and smooth the skin prior to the blades contacting the skin. In some cases these guards have a plurality of fins.

SUMMARY

Generally, this invention relates to razor cartridges with elastomeric guards. The guards have a plurality of curved fins. In some implementations, at least some of the fins are of substantially the same length, e.g., their chord lengths are within 10% of each other, e.g. within 5%.

In one aspect, the invention features a razor cartridge comprising a housing, one or more blades disposed in the housing, and an elastomeric guard member disposed on the housing and positioned to contact the skin prior to the blades, the guard member comprising a plurality of fins that are arcs of concentric circles.

Some implementations include one or more of the following features.

The guard member may include from 2 to 8 fins. At least two of the fins may have a length that is at least 19 mm. The height of at least some of the fins in relation to each other may increase with increasing proximity of the fins to the blades. The radii of curvature of the tips of the fins may be from about 0.025 to 1.12 mm. The fins may have arc lengths from about 19.05 to 50.8 millimeters.

The fin closest to the blades may be taller than the blades, and may function as an elastomeric guard bar. The housing comprises a guard bar support positioned against the elastomeric guard bar.

The fins may be formed, for example, of an elastomer having a durometer of 20 to 80 Shore A. In some cases, distal ends of the fins are free to move, e.g., because they are not joined to the sides of the guard member or the housing In another aspect, the invention features a razor cartridge comprising a housing, one or more blades disposed in the housing, and an elastomeric guard member disposed on the housing and positioned to contact the skin prior to the blades, the guard member comprising a plurality of curved fins, at least two of the fins having a length that is within 50 percent of each other.

Some implementations of this aspect of the invention may include any of the above features, and/or any one or more of the following features.

At least two of the fins, and in some cases all of the fins, may have a length that is within 20 percent of each other. The fins may have a width of from about 19 to 63.5 mm.

In another aspect, the invention features a razor cartridge comprising a housing, one or more blades disposed in the housing, and an elastomeric guard member disposed on the housing and positioned to contact the skin prior to the blades, the guard member comprising a plurality of curved fins extending from a common base, wherein at least two of the fins extend from the base to different heights.

Some implementations of this aspect of the invention may include any of the above features.

DETAILED DESCRIPTION

Figure 1:
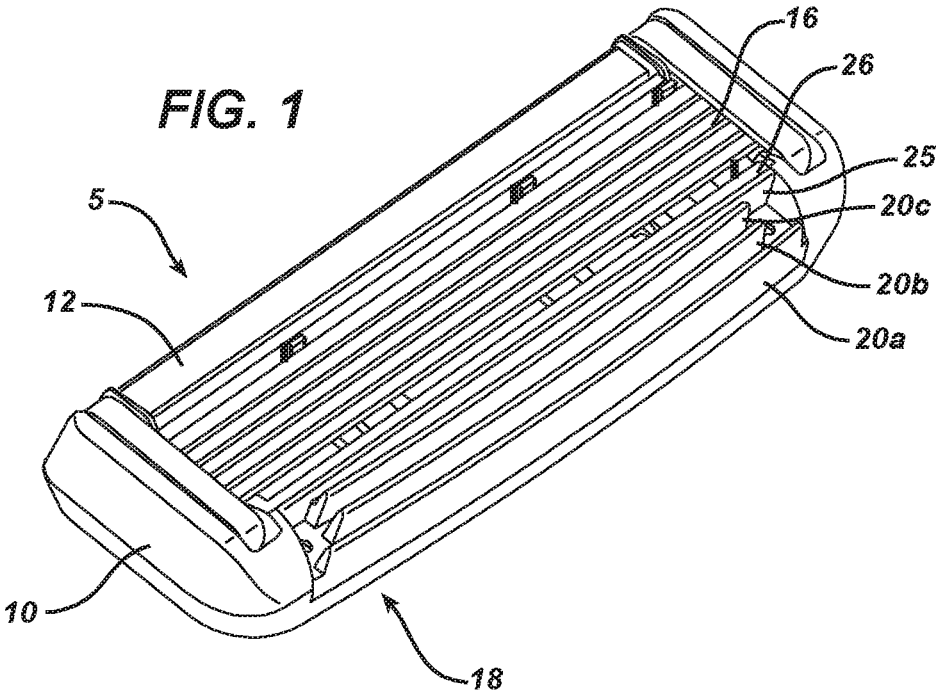
FIG. 1 is a perspective view of a razor cartridge.
Figure 2:
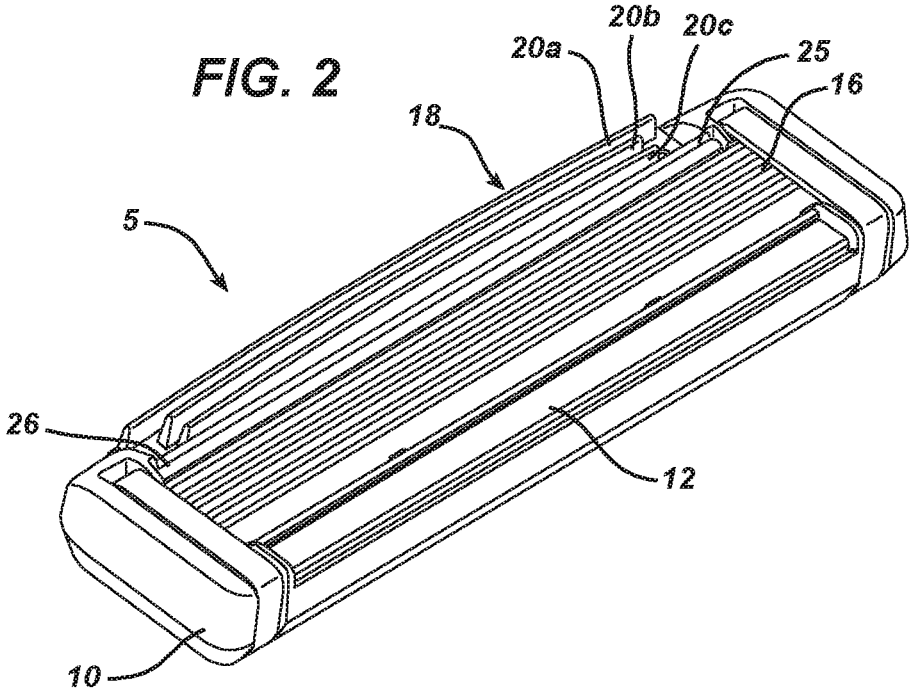
FIG. 2 is a perspective view of the cartridge shown in FIG. 1 rotated 180°.

Referring to FIGS. 1 and 2, razor cartridge 5 includes a cartridge housing 10. A plurality of blades 16 are positioned within cartridge housing 10 substantially parallel to a long edge of the cartridge housing 10. An elastomeric guard 18 having a plurality of fins 20 is mounted on a long edge of the cartridge housing 10. The guard 18 also includes an integral guard bar 25. Guard bar support 26 is disposed between fins 20 and blades 16 on the housing. Moisturizing strip 12 is positioned behind the blades on the opposite long edge of the cartridge housing.

During use, the user draws the razor cartridge 5 across the skin so that the fins 20 contact the desired area to be shaved prior to guard bar 25. The skin and hair then contact the blades, followed by the moisturizing strip. As the user draws the shaving unit across the skin to be shaved, the fins 20 slightly stretch and smooth the skin and hair before contact with guard bar 25. Guard bar 25 prepares, i.e., straightens and stretches, the skin and hair prior to contact with the blades. Guard bar support 26 stabilizes guard bar 25 keeping guard bar 25 from deflecting or moving. The guard bar support is preferably constructed from a hard plastic to give it sufficient rigidity to provide this support.

Figure 3:
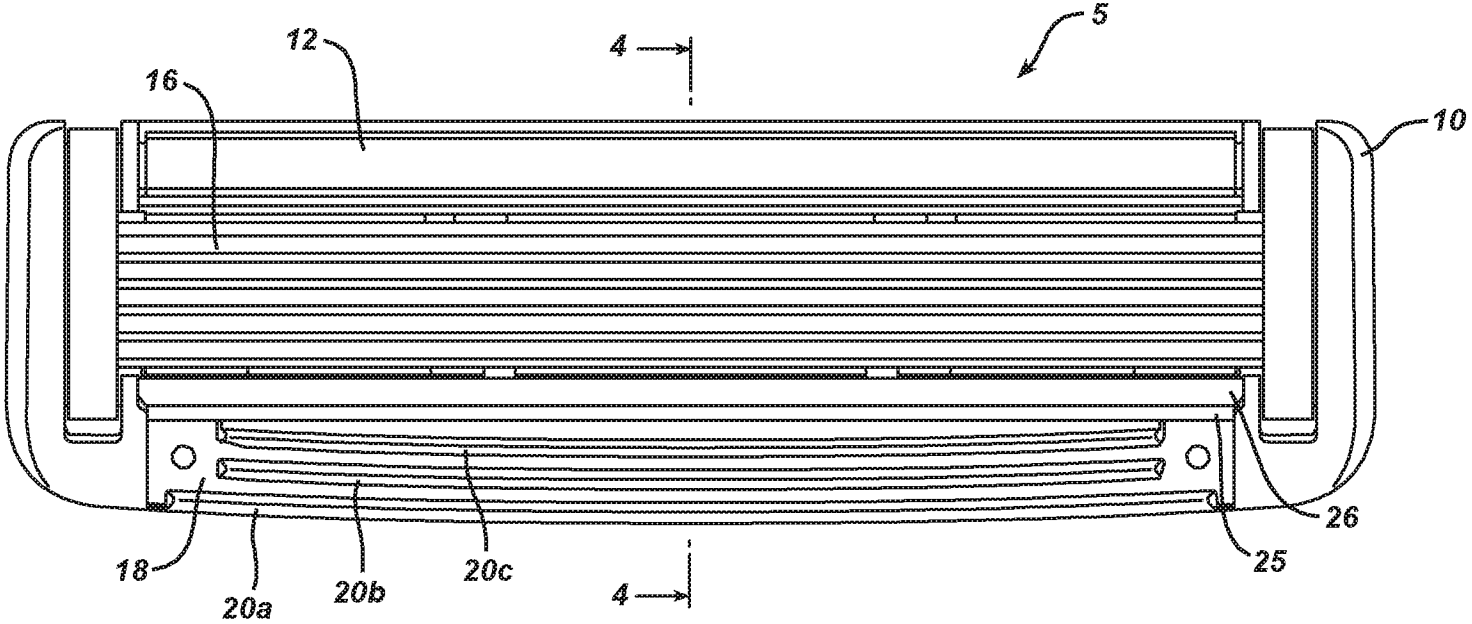
FIG. 3 is a planar-top view of the cartridge.

Referring to FIG. 3, fins 20 are curved such that they are arcs of concentric circles. Each of the fins has a relatively large radius of curvature, relative to the length of the cartridge, such that the fins appear to be almost straight. In preferred implementations, the difference between the radii of curvature of the fins along their length is relatively small or non-existent.

The edges of fins 20 are not connected to each other or to the cartridge housing 16, allowing the fins to flex at their edge. The fins extend substantially the entire length of the cartridge. The leading fin 20*a*, which contacts the skin first, is slightly longer than the other two fins 20*b*, 20*c*. Preferably, the arc lengths of the fins could be from about 19 to 51 millimeters, e.g., from about 28 to 48 millimeters.

The radii of the tips of fins 20 are preferably relatively small, e.g., 0.05 millimeters. In some cases, the radii could be from 0.025 to 1.12 millimeters, for example from 0.02 to 0.07 millimeters. The distance between each fin is preferably about 1 millimeter but could be less, e.g., about 0.5 millimeters or more, e.g. about 1.5 millimeters.

The curved configuration of the fins causes them to non-uniformly collapse, which in combination with the free-flexing nature of the fins, provides differential skin stretching as the guard moves over the skin. The differential skin stretching may provide a more consistent, closer shave. Additionally, the spacing between the fins allows room for the fins to deflect while managing the skin and hair, prior to contact with the elastomer guard bar.

Figure 4:
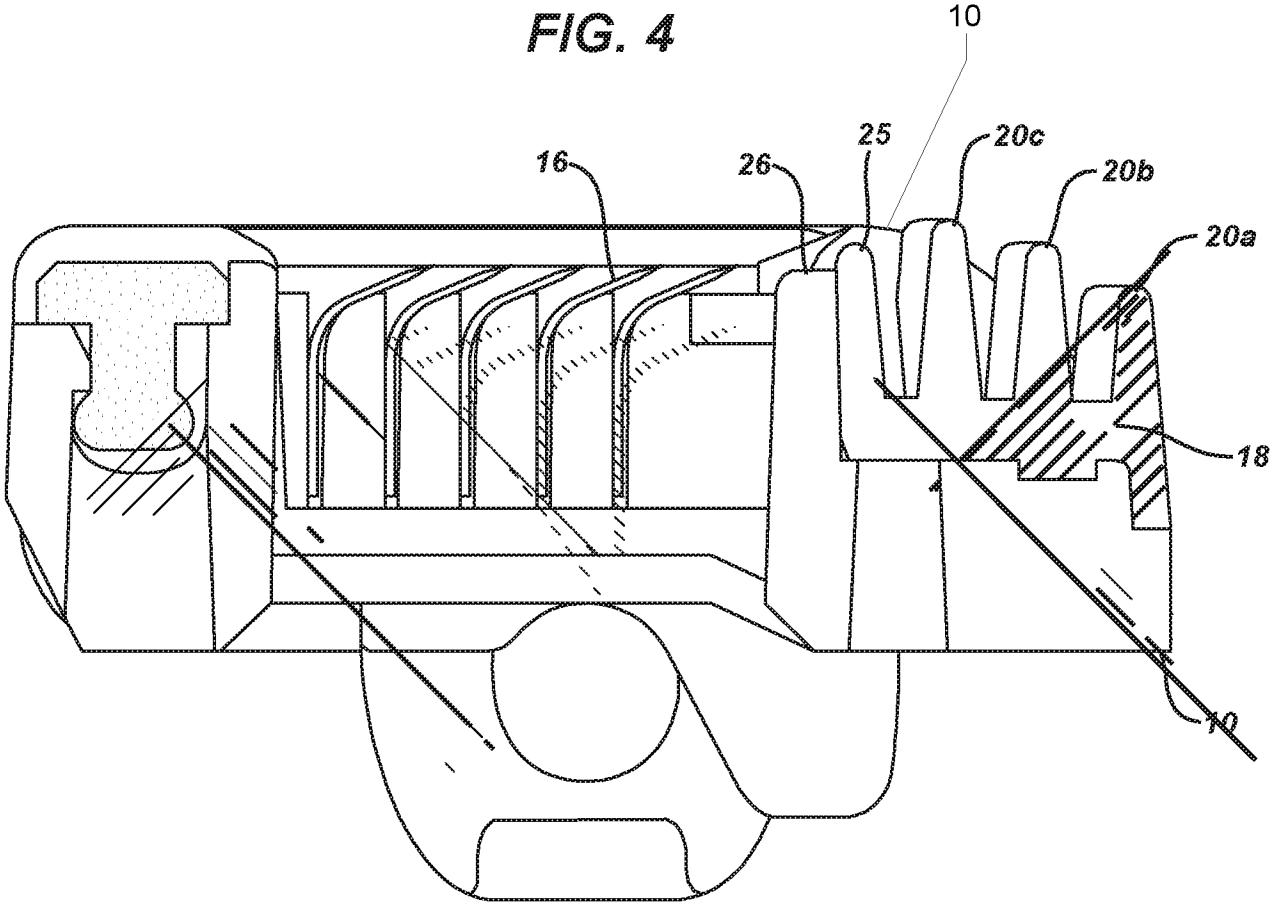
FIG. 4 is sectional view of the cartridge taken along line 4 shown in FIG. 3.

As seen in FIGS. 3 and 4, the fins 20 increase in height relative to one another moving closer to blades 16, providing progressive skin contact and skin stretch. Elastomeric guard bar 25 is shorter than the proceeding fin but taller than the guard bar support 26. Guard bar support 26 is lower (shorter) than the blades 16 and is formed integrally with the housing 10. As shown in FIG. 4, fins 20*b* and 20*c* extend above the skin-contacting surface of guard bar support 26, and also above the plane defined by the edges of blades 16. This allows these fins to engage (stretch and straighten) the skin and hair during a shaving stroke. Preferably the fins 20*b* and 20*c* extend above guard bar 25 at least 0.254 millimeters. In some cases, the fins extend at least 0.5 millimeters above the guard bar. The first fin to contact the skin, fin 20*a*, is lower than the guard bar. In some cases, fin 20*a* could be at least 0.254 millimeters lower than guard bar 25.

Preferably, the fins are formed, for example, from synthetic or natural rubber materials. Generally, the fins are integral with the guard, and thus are formed from the same material as the guard. Suitable guard materials are well known in the shaving system art, and include, for example, polyether-based thermoplastic elastomers (TPEs) available from Kraiburg HTP, polyether-based thermoplastic vulcanizate elastomer (TPVs) available from Exxon Mobil Corporation under the tradename Santoprene™. Preferred elastomers have a durometer from 20 to 80 e.g., from 40 to 60 Shore A.

The guard may be attached to the cartridge housing 10 in any desired manner, e.g., by co-molding (e.g. transfer molding, multi-material molding or other similar techniques).

OTHER EMBODIMENTS

A number of embodiments have been described. Nevertheless, it will be understood that various modifications may be made without departing from the spirit and scope of the disclosure.

Another embodiment could feature a plurality of fins configured in at least two or more sets of concentric arcs.

An alternate embodiment could feature a different number of curved fins. For example, the cartridge could feature at least 2 fins and up to or greater than 6 fins.

Accordingly, other embodiments are within the scope of the following claims.

What is claimed is:

1. A device comprising:

a housing, one or more blades disposed in the housing, the blades having edges that define a blade plane, and an elastomeric guard member disposed on the housing and positioned to contact the skin prior to the blades, the guard member comprising a plurality of fins that are arcs of concentric circles, the fins extending upward from a planar top surface of a common base to a tip, and a linear elastomeric guard bar that extends upward from the planar top surface to a height that is lower than that of at least one of the plurality of fins wherein the plurality of fins are in the form of elongated, thin flat members, each fin extends the major part of the length of the guard member, the plurality of fins comprise a first skin engaging fin (20*a*) having a top surface that is lower than the blade plane, and the height from base to tip of each fin increases with increasing proximity of the fins to the one or more blades, with at least one fin being higher than the blade plane.

2. The device of claim 1, wherein the plurality of fins comprises at least three fins.

3. The device of claim 1, wherein at least two of the fins have a length that is at least 19 mm.

4. The device of claim 1, wherein distal ends of the fins are free to move.

5. The device of claim 1, wherein the elastomeric guard bar is adjacent to the blades and higher than the blade plane.

6. The device of claim 5, wherein the housing comprises a guard bar support positioned against the elastomeric guard bar.

7. The device of claim 6, wherein the guard bar support is lower than the blade plane.

8. The device of claim 1, wherein the fins are formed of an elastomer having a durometer of 20 to 80 Shore A.

9. The device of claim 1, wherein the radii of curvature of the tips of the fins is from 0.025 to 1.12 mm.

10. The device of claim 1, wherein the fins have arc lengths from 19.05 to 50.8 millimeters.

11. The device of claim 1, wherein at least one of the fins has a length that is within 50 percent of a length of one of the other fins.

12. The device of claim 11, wherein each of the fins has a length that is within 20 percent of a length of each other fin.

13. The device of claim 11, wherein the width of the fins is from 19 to 63.5 mm.

14. The device of claim 1, wherein each fin has a substantially uniform height along its length.

* * * * *